US006038960A

United States Patent [19]

Fukushima et al.

[11] Patent Number: 6,038,960

[45] Date of Patent: Mar. 21, 2000

[54] RECIPROCATING PISTONS OF PISTON-TYPE COMPRESSOR

[75] Inventors: Eiji Fukushima; Shigemi Shimizu, both of Gunma, Japan

[73] Assignee: Sanden Corporation, Gunma, Japan

[21] Appl. No.: 09/168,154

[22] Filed: Oct. 8, 1998

[30] Foreign Application Priority Data

Oct. 8, 1997 [JP] Japan ..... P09-275756

[51] Int. Cl.[7] ..... F01B 3/00; F01B 13/04

[52] U.S. Cl. ..... 92/12.2; 92/57; 92/71; 92/154; 417/269

[58] Field of Search ..... 417/269; 92/12.2, 92/57, 171, 153, 154

[56] References Cited

U.S. PATENT DOCUMENTS

| | | | |
|---|---|---|---|
| 1,714,145 | 11/1929 | Sperry . | |
| 2,048,272 | 7/1936 | Linthicum | 92/12.2 X |
| 2,570,843 | 10/1951 | Orshansky, Jr. | 92/12.2 X |
| 3,369,458 | 2/1968 | Slimm . | |
| 3,800,675 | 4/1974 | Jacobs . | |
| 3,885,460 | 5/1975 | Park . | |
| 3,982,471 | 9/1976 | Finger . | |
| 4,065,229 | 12/1977 | Black . | |
| 4,073,603 | 2/1978 | Abendschein et al. . | |
| 4,145,163 | 3/1979 | Fogelberg et al. . | |
| 4,174,191 | 11/1979 | Roberts . | |
| 4,351,227 | 9/1982 | Copp, Jr. et al. . | |
| 4,379,425 | 4/1983 | Ishizuka . | |
| 4,416,589 | 11/1983 | Perry . | |
| 4,425,837 | 1/1984 | Livesay . | |
| 4,480,964 | 11/1984 | Skinner . | |
| 4,526,516 | 7/1985 | Swain et al. . | |
| 4,594,055 | 6/1986 | Hatakeyama et al. . | |
| 4,664,604 | 5/1987 | Terauchi . | |
| 5,174,728 | 12/1992 | Kimura et al. . | |
| 5,380,167 | 1/1995 | Burkett et al. . | |
| 5,382,139 | 1/1995 | Kawaguchi et al. . | |
| 5,573,380 | 11/1996 | Martensen et al. | 417/269 |
| 5,630,353 | 5/1997 | Mittlefehldt et al. . | |
| 5,765,464 | 6/1998 | Morita . | |

FOREIGN PATENT DOCUMENTS

| | | |
|---|---|---|
| 3602651 | 7/1987 | Germany . |
| 4207186 | 9/1992 | Germany . |
| 4109481 | 9/1992 | Japan . |
| 7189897 | 7/1995 | Japan . |
| 7189898 | 7/1995 | Japan . |
| 7189900 | 7/1996 | Japan . |
| 9105380 | 4/1997 | Japan . |
| 895667 | 5/1962 | United Kingdom . |

*Primary Examiner*—Hoang Nguyen
*Attorney, Agent, or Firm*—Baker Botts L.L.P.

[57] ABSTRACT

A piston-type fluid displacement apparatus includes a housing enclosing a crank chamber, a suction chamber, a suction chamber, and a discharge chamber. The housing includes a cylinder block wherein a plurality of cylinder bores formed, a drive shaft rotatably supported in the cylinder block and a plurality of pistons each of which is slidably disposed within one of the cylinder bores. Each of the pistons includes a cylindrical body and an arm portion axially extending from a first axial end of the cylindrical body and a pair of engaging portions formed the first axial end of the cylindrical body and the arm portion. The cylindrical body of the pistons includes an hollow portion therein. The housing further includes a plate having an angle of tilt and titably connected to the drive shaft and bearing coupling devices coupling the plate to each of the pistons, so that the pistons reciprocates within the cylinder bores upon rotation of the plate. A plurality of apertures are formed on the first axial end of the cylindrical body of the piston and fluidly communicated with the hollow portion of the piston. At least two of the apertures have respectively a rectangular shape.

9 Claims, 8 Drawing Sheets

RECIPROCATING PISTONS OF PISTON-TYPE COMPRESSOR

BACKGROUND OF THE INVENTION

1. Field of Invention

The present invention relates to a piston-type compressor, in which fluid is compressed by means of reciprocating pistons connected to a swash plate. More particularly, it relates to a configuration of reciprocating pistons, which reduces the weight of the pistons in the refrigerator compressor for an automotive air conditioning system.

2. Description of the Related Art

Piston-type refrigerant compressors are typically used in air conditioning apparatuses for automobiles. A known piston-type refrigerant compressor is disclosed in U.S. Pat. No. 5,174,728 to Kimura et al. and in Japanese unexamined publication No. H9-105380, both of which are herein incorporated by reference in their entireties.

A description will be made with regard to a swash plate-type compressor as a reciprocating compressor. In the following description, and for convenience only, the left side of FIG. 1 will be referred to as the front side of the compressor while the right side thereof will be referred to as the rear side of the compressor.

Referring to FIG. 1, a compressor, which is generally designated by reference number 100, includes an annular casing forming closed cylinder housing 10. Closed cylinder housing 10 is provided with cylinder block 22, a hollow portion, such as a crank chamber 31, a front end plate 13, and a rear end plate 26. Pistons 11 are accommodated in cylinder bores 21 and reciprocate therein. Drive shaft 15, which is driven by an engine (not shown), is rotatably supported by means of the central portion of cylinder block 22 and front end plate 13. Rotor plate 14 is mounted on drive shaft 15, and synchronously rotates with drive shaft 15. Further, swash plate 20 is tiltably mounted on drive shaft 15, and is reciprocally slidable together with special sleeve 17, which is parallel to the axis of drive shaft 15. Rotor plate 14 and swash plate 20 are connected to each other by means of a hinge mechanism (not shown). Swash plate 20 engages the interior portion of the associated piston 11 along its circumference.

Cylinder block 22 is provided with communication passage 23, which allows crank chamber 31 to communicate with suction chamber 42. Communication passage 23 includes bellows 28, which opens and closes communication passage 23 according to a differential pressure and a suction pressure.

Control of the displacement of compressor 100 is achieved by varying the stroke of piston 11. The stroke of piston 11 varies in accordance with a difference between the pressures acting on the opposing sides of swash plate 20. A pressure difference is generated by balancing the pressure in crank chamber 31 acting on the rear surface of piston 11, and the suction pressure in cylinder bore 21 acting on the front surface of piston 11. The suction pressure acts on swash plate 20, through piston 11.

According to the above-described compressor 100, when drive shaft 15 rotates, rotor plate 14 rotates with drive shaft 15. The rotation of rotor plate 14 is transferred to swash plate 20 through hinge mechanism (not shown). Rotor plate 20 rotates with a surface inclined with respect to drive shaft 15, so that pistons 11 reciprocate in their respective cylinder bores 21. Therefore, refrigerant gas is drawn into suction chamber 42 and compressed, and then discharged from the inlet chamber into an associated discharge chamber 44.

Thus, the volume of compressed refrigerant gas discharged into discharge chamber 44 is regulated accordingly, as the pressure in crank chamber 31 is controlled so as to open and close communication passage 23 in relation to the differential pressure between the suction pressure and the preset pressure of bellows 28.

When the suction pressure is higher than the preset pressure of bellows 28, the communication passage 23 opens, the pressure in crank chamber 31 decreases, rotor plate 14 tilts to rotate with a greater angle with respect to drive shaft 15, and the stroke of piston 11 increases. As a result, the compression capacity of compressor 100 increases. On the other hand, when the suction pressure is other than the preset pressure of bellows 28, communication passage 23 closes, the pressure in crank chamber 31 increases, rotor plate 14 tilts to rotated with a smaller angle with respect to drive shaft 15, and the stroke of piston 11 increases. As a result, the compression capacity of compressor 100 decreases. Further, some of the refrigerant gas that remains in cylinder bore 21 is used as lubricating oil, which leaks into crank chamber 31 so as to lubricate the surface between rotor plate 14 and sleeves 17.

Referring to FIG. 2, piston 11 includes a cylindrical main body 12 which is sealingly formed with an open space (not shown) therein. Cylindrical main body 12 is provided with an annular groove 13 on the peripheral surface thereof for receiving a lubricating oil therein. Annular groove 13 is formed on a portion of piston 11 that is constantly located in cylinder bore 21 of cylinder block 22 during operation; thus, annular groove 13 does not enter crank chamber 31 even when piston 11 is located at bottom dead center of piston 11. Annular groove 13 includes three apertures 24, which communicate fluidly with open space 11*a,* at equal intervals.

Referring to FIGS. 3 and 4, piston 11 includes three second apertures 25, which are fluidly communicated with open space 11*a,* at equal intervals. Piston 11 includes first arm portion 16 axially extending from the one end of cylindrical main body 12, and integrally connected to the part of the peripheral surface of piston 11. Piston 11 also includes second arm portion 17 radially extending from one end of first arm portion 16. Piston 11 further includes a first shoe supporting portion 18. First shoe supporting portion 18 is formed on one axial end 11*b* of cylindrical main body 12. A second shoe supporting portion 19 is formed on one axial end of second arm portion 17 so as to face first shoe supporting portion 18. Each piston 11, which are manufactured as mentioned above, is slidably supported by sleeves 17, which are disposed in first shoe supporting portion 18 and second shoe supporting portion 19, and are inserted into and slidably disposed in cylinder bore 21.

When compressor 100 provided with piston 11 is activated, the rotary motion of drive shaft 15 is transmuted to swash plate 20 via rotor plate 14 and guide pins (not shown). Thus, each piston 11 reciprocates within its respective bore 21 so that suction gas is introduced into corresponding bore 21, then compressed and discharged as discharge gas into discharge chamber 44. Depending on a pressure differential between pressure in crank chamber 31 and suction chamber 42, the inclination of swash plate 20, and thus the stroke of piston 11, are changed to control the capacity of compressor 100 in a manner known in the art. The pressure in the crank chamber 31 is controlled by a control valve mechanism (not shown) provided in cylinder block 22 depending on the heat load.

According to the operation of compressor 100, cylinder bore 21 may be subjected to high pressure and low pressure conditions, alternatively. Due to the presence of first apertures 24 of piston 11, during the reciprocation of piston 11, first apertures 24 allow a breathing operation by permitting an alternate flow-in and flow-out of refrigerant gas between open space 11*a* and cylinder bore 21. A similar breathing operation is carried out to permit an alternate flow-in and flow-out of refrigerant gas between open space 11*a* and crank chamber 31 through second apertures 25 to thereby assist a smooth breathing operation between open space 11*a* and crank chamber 31.

Lubricating oil included in refrigerant gas adheres to inner surface of cylinder bore 21. As it reciprocates, annular groove 13 scrapes and catches lubricating oil on the inner surface of cylinder bore 21. Therefore, highly condensed refrigerant gas flows into open space 11*a* and crank chamber 31. Some of the refrigerant gas is effectively used as lubricating oil, which lubricates the sliding surface between rotor plate 14 and sleeves 17 in crank chamber 31.

Although piston 11 requires open space 11*a* formed therein, and for cylindrical main body 12 to have a thin thickness in order to reduce the weight of the piston 11, it is desirable to provide a lighter weight piston in the compressor used in an automobile.

Generally, a pair of members for piston are assembled to a piston by welding in a vacuum. According to this manufacturing process, each piston has to be manufactured in a complex manner in vacuums, since a pair of members forming piston 11 are welded in a vacuum after being connected to each other.

SUMMARY OF THE INVENTION

It is an object of the present invention to provide a piston-type compressor which has light weight pistons while maintaining the strength of the pistons.

It is still another object of the present invention to provide a piston-type compressor which is simple to manufacture.

According to the present invention, a piston-type fluid displacement apparatus includes a housing enclosing a crank chamber, a suction chamber, a suction chamber, and a discharge chamber. The housing includes a cylinder block wherein a plurality o cylinder bores formed, a drive shaft rotatably supported in the cylinder block and a plurality of pistons each of which is slidably disposed within one of the cylinder bores. Each of the pistons includes a cylindrical body and an arm portion axially extending from a first axial end of the cylindrical body and a pair of engaging portions formed the first axial end of the cylindrical body and the arm portion. The cylindrical body of the pistons includes an hollow portion therein. The housing further includes a plate having an angle of tilt and titably connected to the drive shaft and bearing coupling devices coupling the plate to each of the pistons, so that the pistons reciprocates within the cylinder bores upon rotation of the plate.

A plurality of apertures are formed on the first axial end of the cylindrical body of the piston and fluidly communicated with the hollow portion of the piston. At least two of the apertures have respectively a rectangular shape.

Further objects, features and advantages of this invention will be understood from the following detailed description of preferred embodiments with reference to the attached drawings.

DETAILED DESCRIPTION OF THE PREFERRED EMBODIMENTS

Figure 1:
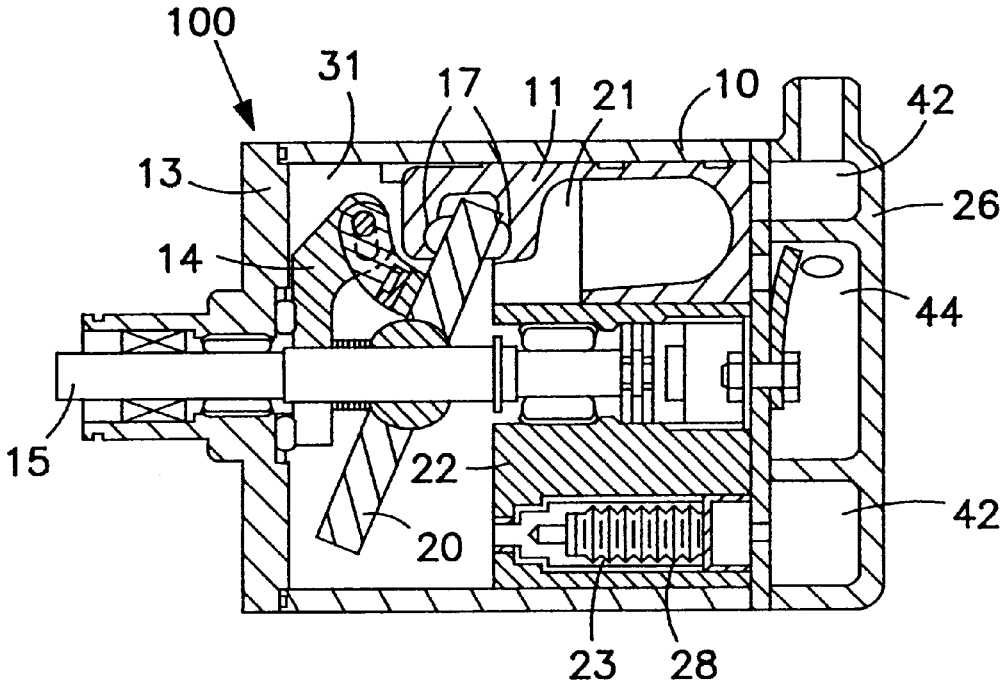
FIG. 1 PRIOR ART
FIG. 1 is a longitudinal cross-sectional view of a known swash plate-type refrigerant compressor with a variable displacement mechanism.
Figure 2:
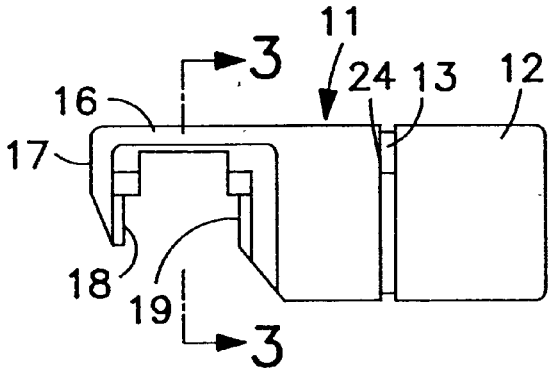
FIG. 2 PRIOR ART
FIG. 2 is a side view of a known piston.
Figure 3:
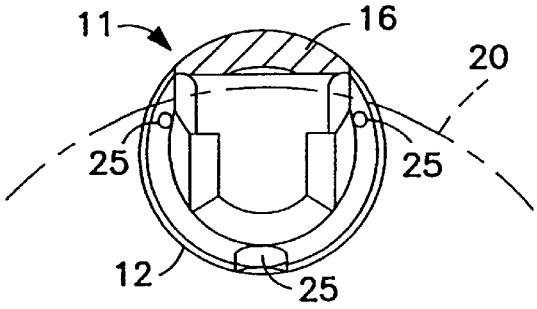
FIG. 3 PRIOR ART
FIG. 3 is a cross-sectional view of a known piston taken along lines 3—3.
Figure 4:
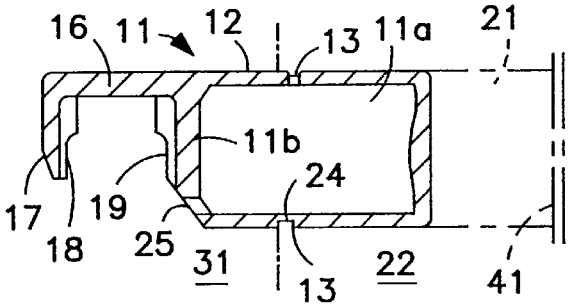
FIG. 4 PRIOR ART
FIG. 4 is a cross-sectional view of the known piston of FIG. 2.
Figure 5:
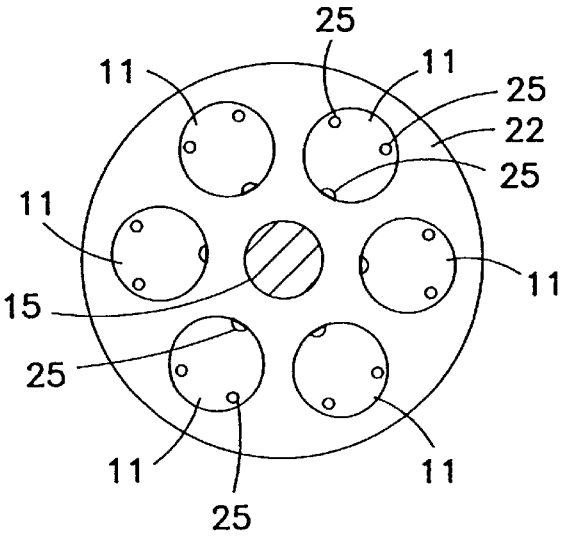
FIG. 5 PRIOR ART
FIG. 5 is a cross-sectional view of the known swash plate-type refrigerant compressor of FIG. 1.
Figure 6:
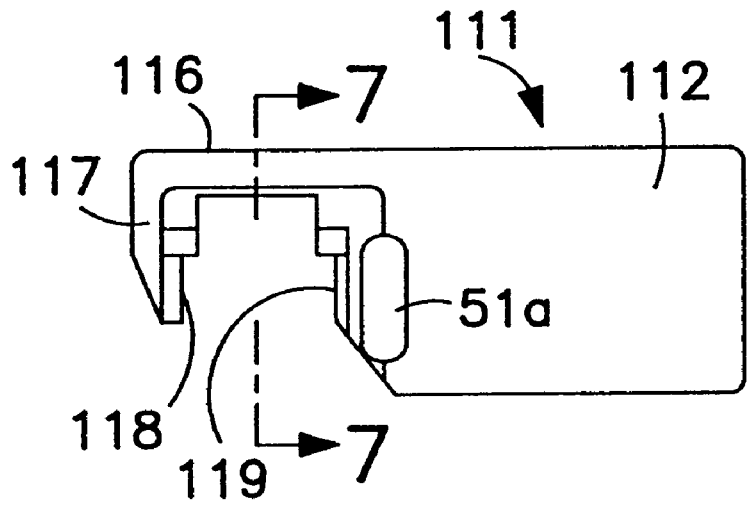
FIG. 6 is a side view of a piston in accordance with a first embodiment of the present invention.
Figure 7:
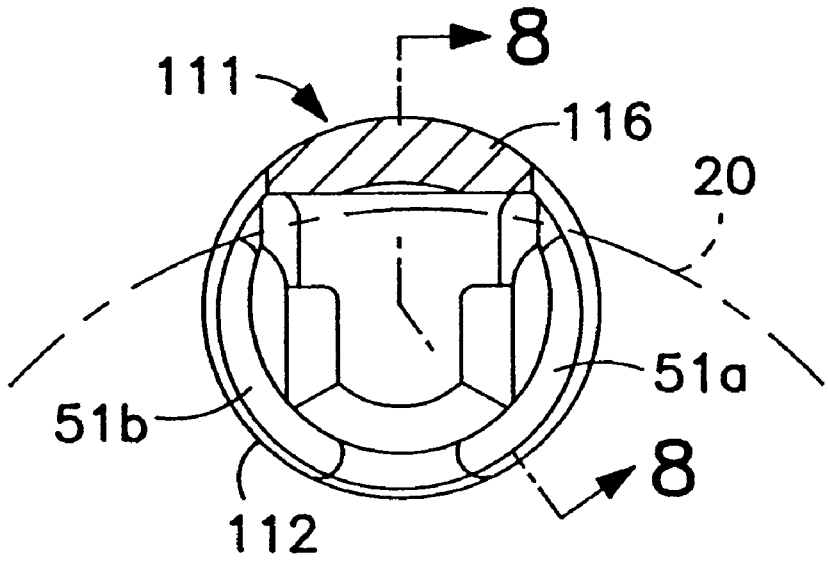
FIG. 7 is a cross-sectional view of the piston taken along lines 8—8 in accordance with the first embodiment of the present invention.
Figure 8:
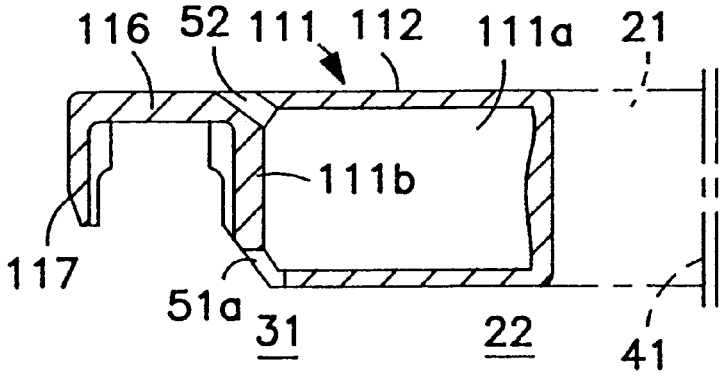
FIG. 8 is a cross-sectional view of the piston of FIG. 6 in accordance with the first embodiment of the present invention.

The embodiments of the present invention are illustrated in FIGS. 6–17, in which the same numerals are used to denote elements which correspond to similar elements depicted in FIGS. 1–5. A detailed explanation of several elements and characteristics of the known compressor is provided above and is therefore omitted from this section.

Referring to FIGS. 6–9, piston 11 includes a cylindrical main body 112 which is sealingly formed with an open space 11*a* therein. Piston 111 includes first arm portion 116, axially extending from the one end of cylindrical main body 112 and integrally connected to the part of the peripheral surface of piston 111, and a second arm portion 117, radially extending from one end of first arm portion 116. Piston 111 includes a pair of shoe supporting portions 118 and 119. First shoe supporting portion 118 is formed on one axial end 111*b* of cylindrical main body 112. Second shoe supporting portion 119 is formed on one axial end of second arm portion 117 so as to face first shoe supporting portion 118. Cylindrical main body 112 includes pair of apertures 51*a* and 51*b*, formed on an edge portion of second shoe supporting portion 119. Open space 111*a* of cylindrical main body 112 is formed for the purpose of reducing the weight of piston 11. Pair of apertures 51*a* and 51*b* are formed oppositely along the circumference surface of cylindrical main body 112 so as to fluidly communicate open space 111*a* with the exterior of piston 111. Pair of apertures 51*a* and 51*b* radially extend from the bottom side of cylindrical main body 112 to the vicinity of first arm portion 116. Pair of apertures 51*a* and 51*b* may have a rectangular shape in order to reduce the weight of piston 111. Further, pair of apertures 51*a* and 51*b* include part of the peripheral surface of cylindrical main body 112 of piston 111. Second aperture 52 is formed on one axial end 111*b* of cylindrical main body 112 so as to fluidly communicate open space 111*a* with the exterior of piston 111. Small aperture 52 extends from one of the corner of open space 111*a* to radial outside surface of first arm portion 16.

Thus, piston 111, which has a sealed open space 111*a* therein, is manufactured such that a pair of members for piston 111 are connected to each other by welding. A pair of members are welded so as to be attached by a welding machine. According to this manufacturing process, open space 111*a* of piston 111 may be formed by a cutting process, and cylindrical main body 112 has a thin thickness. For example, a pair of members for piston 111 may be manufactured by forging, and then a pair of apertures 51*a* and 51*b* may be simultaneously formed. Small aperture 52 may be formed by a machining process after forging of piston 111.

Each piston 111, which may be manufactured as discussed above, is slidably supported by shoes 117, which are disposed in first shoe supporting portion 118 and second shoe supporting portion 119, and is inserted into and slidably disposed in cylinder bore 21.

When the compressor provided with the above piston 111 is activated, a rotary motion of drive shaft 15 is transmuted to swash plate 20 via rotor plate 14 and guide pins (not shown). Thus, each piston 111 reciprocates within the corresponding bore 21 so that the suction gas is introduced into corresponding bore 21, then compressed and discharged as discharge gas into discharge chamber 44. Depending on a pressure differential between pressure in crank chamber 31 and suction chamber 42, the inclination of swash plate 20 and thus the stroke of piston 111 are changed to control the capacity of the compressor in a manner known in the art. The pressure in crank chamber 31 is controlled by a control valve mechanism (not shown) provided in cylinder block 22 depending on the heat load.

Figure 9:
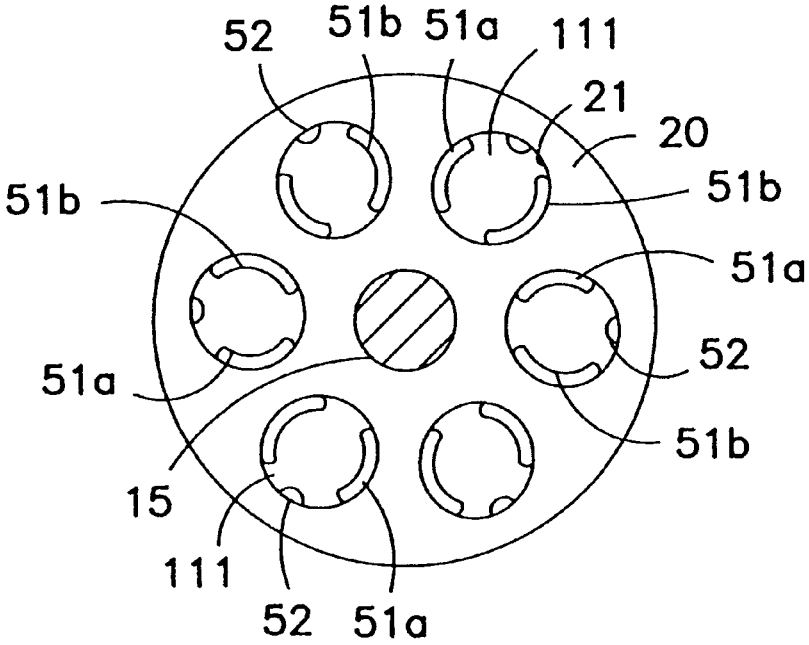
FIG. 9 is a cross-sectional view of the swash plate-type refrigerant compressor in accordance with the first embodiment of the present invention.
Figure 10:
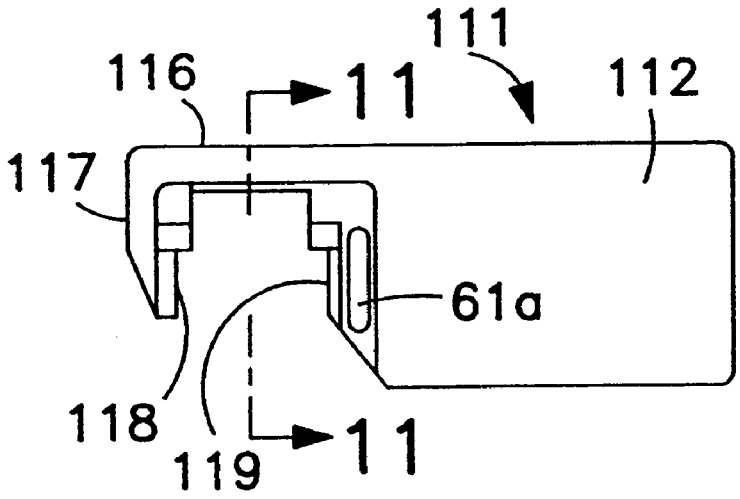
FIG. 10 is a side view of a piston in accordance with a second embodiment of the present invention.
Figure 11:
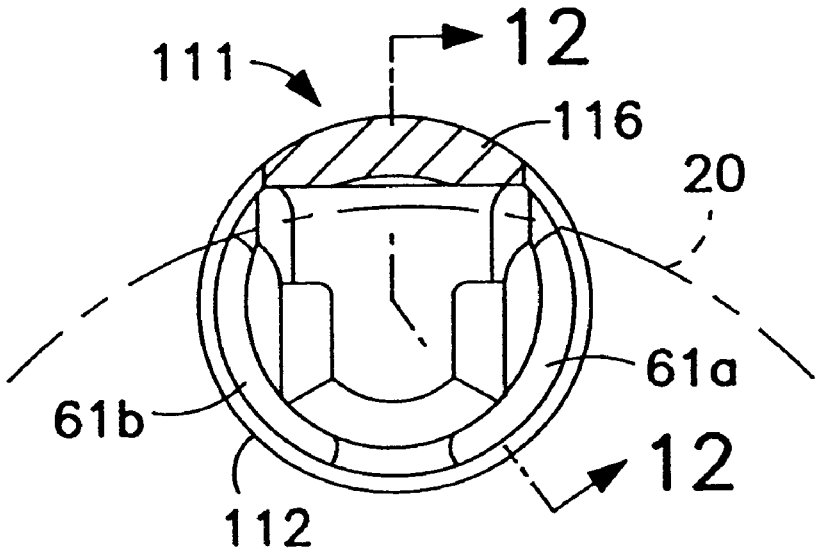
FIG. 11 is a cross-sectional view of the piston taken along lines 12—12 in accordance with the second embodiment of the present invention.
Figure 12:
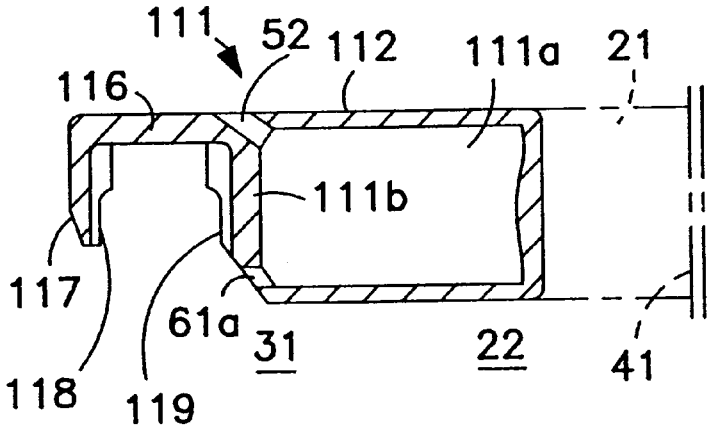
FIG. 12 is a cross-sectional view of the piston in accordance with the second embodiment of the present invention.
Figure 13:
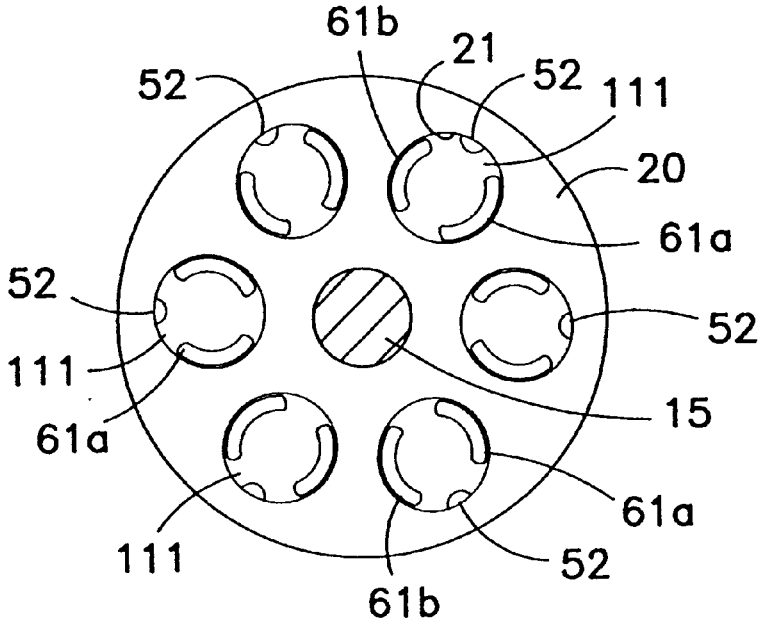
FIG. 13 is a cross-sectional view of the swash plate-type refrigerant compressor in accordance with the second embodiment of the present invention.
Figure 14:
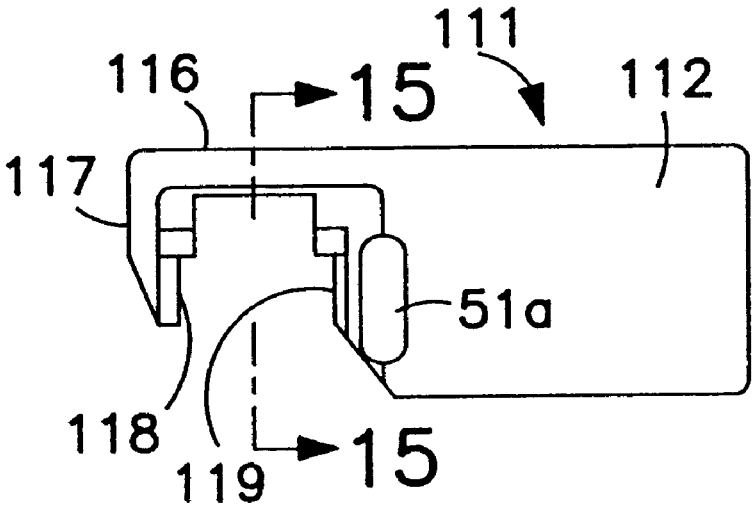
FIG. 14 is a side view of a piston in accordance with a third embodiment of the present invention.
Figure 15:
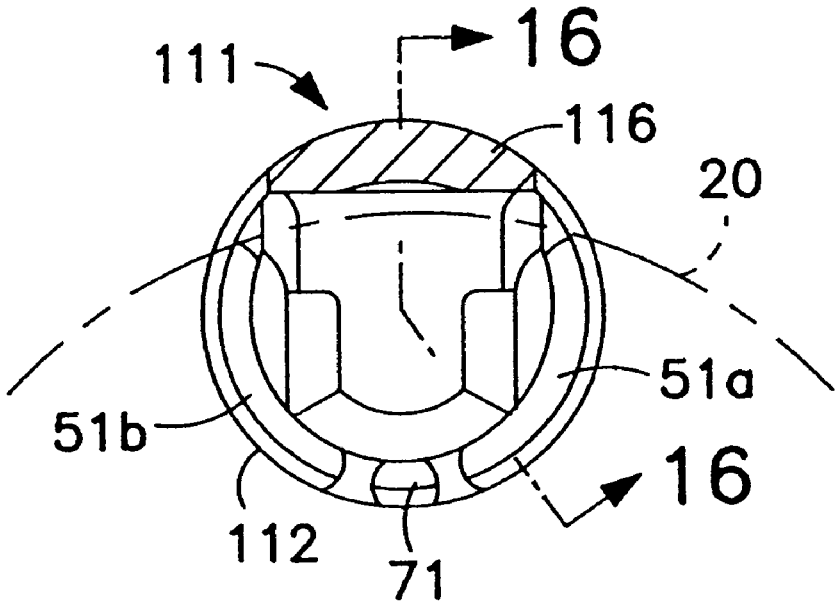
FIG. 15 is a cross-sectional view of the piston taken along lines 16—16 in accordance with the third embodiment of the present invention.
Figure 16:
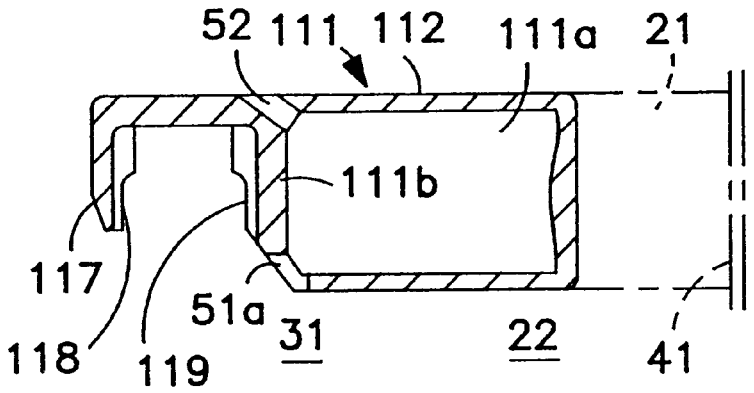
FIG. 16 is a cross-sectional view of the piston in accordance with the third embodiment of the present invention.
Figure 17:
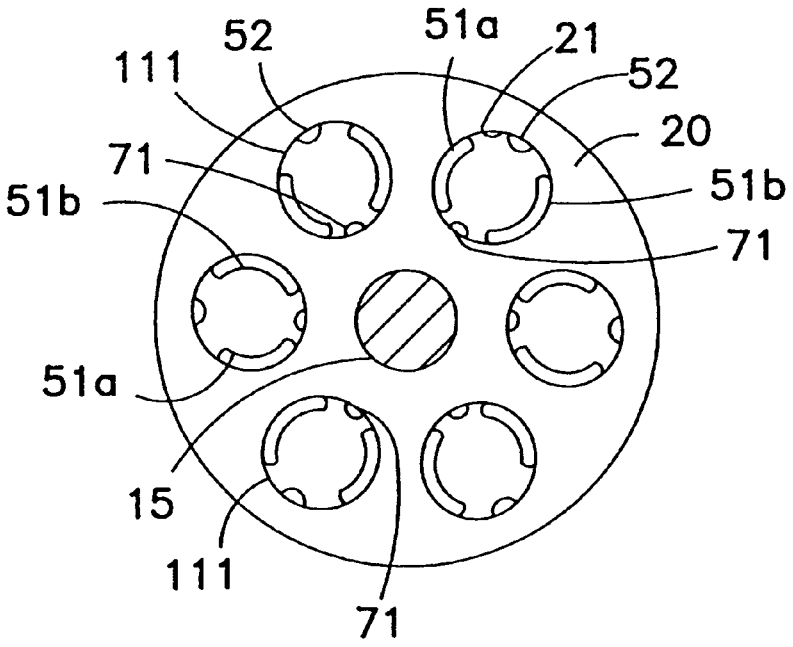
FIG. 17 is a cross-sectional view of the swash plate-type refrigerant compressor in accordance with the third embodiment of the present invention.

Referring to FIG. 9, refrigerant gas in cylinder bore 21 is discharged to the exterior of cylinder bore 21 because small aperture 52 is positioned apart from drive shaft 15 and at the bottom of the compressor. In other words, refrigerant gas and lubricating oil, which accumulate in cylinder bore 21 due to gravity and due to the reciprocating movement of piston 111, is discharged to the exterior of cylinder bore 21 because pair of apertures 51*a* and 51*b* and small aperture 52 are positioned at top dead center of the piston 111 regardless of the orientation of the compressor.

Thus, open space 111*a* of piston 111 does not store refrigerant gas therein, and therefore piston 111 does not substantially increase in weight. Further, pair of apertures 51*a* and 51*b* and small aperture 52 contribute to reduce the weight of the piston 111.

Furthermore, since pair of apertures 51*a* and 51*b* and small aperture 52 are located oppositely along the circumference surface of cylindrical main body 112, the periphery of cylindrical main body 112 may have a thinner thickness in comparison to the known piston while first arm portion 116 of piston 111 maintains its strength.

FIGS. 10–13 illustrates a second embodiment of the present invention. Elements in FIGS. 10–13 similar to those in FIGS. 6–9 are designated with the same reference numerals. A detailed explanations of several elements and characteristics of the first embodiment is provided above and is therefore omitted from this embodiment.

Pair of apertures 61*a* and 61*b* are formed on one axial end 11*b* of cylindrical main body 112 so as to fluidly communicate open space 111*a* with the exterior of piston 111. Pair of apertures 61*a* and 61*b* radially extend from the bottom side of cylindrical main body 112 to the vicinity of first arm portion 116. Pair of apertures 61*a* and 61*b* may have a rectangular shape in order to reduce the weight of piston 111. However, pair of apertures 61*a* and 61*b* do not include the part of peripheral surface of cylindrical main body 112 of piston 111, which is different from the first embodiment of the present invention. Small aperture 52 is formed on one axial end 111*b* of cylindrical main body 112 so as to communicate open space 111*a* with the exterior of piston 111, fluidly. Small aperture 52 extends from one of the corner of open space 111*a* to radial outside surface of first arm portion 116.

Substantially the same advantages as those achieved in the first embodiment may be realized in the present embodiment.

FIGS. 14–17 illustrates a third embodiment of the present invention. Elements in FIGS. 14–17 similar to those in FIGS. 6–9 of the first embodiment are designated with the same reference numerals. A detailed explanation of several elements and characteristics of the first embodiment is provided above and is therefore omitted from this embodiment.

Pair of first apertures 51*a* and 51*b* and second aperture 52 are formed in the same manner as in the first embodiment of the present invention. Third aperture 71 is formed between first apertures 51*a* and 51*b* so as to communicate open space 111*a* with the exterior of piston 111, fluidly.

Substantially the same advantages as those achieved in the first embodiment may be realized in the present embodiment. Furthermore, refrigerant gas and lubricating oil accumulated in cylinder bore 21 is discharged to the exterior of cylinder bore 21.

Although the present invention has been described in connection with the preferred embodiments, the invention is not limited thereto. Specifically, while the preferred embodiments illustrate the invention in a swash plate-type compressor, this invention is not restricted to swash plate-type refrigerant compressors, but may be employed in other piston-type compressor or a piston-type fluid displacement apparatus. Accordingly, the embodiments and features disclosed herein are provided by way of example only. It will be easily understood by those of ordinary skill in the art that variations and modifications can be easily made within the scope of this invention as defined by the following claims.

What is claimed is:

1. A piston-type fluid displacement apparatus comprising:

a housing enclosing a crank chamber, a suction chamber, and a discharge chamber, said housing including a cylinder block wherein a plurality of cylinder bores are formed:

a drive shaft rotatably supported in said cylinder block;

a plurality of pistons, each said pistons slidably disposed within one of said cylinder bores, each of said pistons including a cylindrical body and an arm portion axially extending from a first axial end of said cylindrical body, and a pair of engaging portions formed said first axial end of said cylindrical body and said arm portion, said cylindrical body of said pistons including an hollow portion therein;

a plate having an angle of tilt and tiltably connected to said drive shaft;

a bearing coupling said plate to each of said pistons, such that said pistons reciprocates within said cylinder bores upon rotation of said plate; and at least two apertures formed on said first axial end of said cylindrical body of said piston and fluidly communicates with said hollow portion of said piston, said at least two apertures have a rectangular shape and radially extend along said cylindrical body of said piston.

2. The piston-type fluid displacement apparatus of claim 1, wherein at least two of said apertures are oppositely located on said first axial end of said cylindrical body of said piston so as to be along an edge surface of said first axial end of said cylindrical body.

3. The piston-type fluid displacement apparatus of claim 2, wherein each of said at least two apertures extend to a radial peripheral surface of said cylindrical body of said piston.

4. The piston-type fluid displacement apparatus of claim 2, wherein a second aperture is formed between said at least two apertures.

5. The piston-type fluid displacement apparatus of claim 1, wherein said rectangular shape of said at least two apertures extends from said arm portion to a bottom of said first axial end of said cylindrical body.

6. The piston-type fluid displacement apparatus of claim 1, wherein at least one of said apertures is fluidly communicated from an outer surface of said arm portion to said hollow portion of said piston.

7. The piston-type fluid displacement apparatus of claim 4, wherein a third aperture is formed between said at least two apertures.

8. The piston-type fluid displacement apparatus of claim 4, wherein said second aperture fluidly communicates from an outer surface of said arm portion to said hollow portion of said piston.

9. The piston-type fluid displacement apparatus of claim 4, wherein said second aperture is a small aperture.

* * * * *